US006070565A

United States Patent [19]

Miniere

[11] Patent Number: 6,070,565

[45] Date of Patent: Jun. 6, 2000

[54] ROTARY INTERNAL COMBUSTION ENGINE

[76] Inventor: Jack K. Miniere, 2134 Deanna Dr., Apopka, Fla. 32703

[21] Appl. No.: 09/431,110

[22] Filed: Nov. 1, 1999

[51] Int. Cl.[7] ..... F02B 53/00

[52] U.S. Cl. ..... 123/231

[58] Field of Search ..... 123/229, 231

[56] References Cited

U.S. PATENT DOCUMENTS

| | | | |
|---|---|---|---|
| 1,921,782 | 8/1933 | Schaefer | 123/231 |
| 3,872,840 | 3/1975 | Adragna | 123/231 |
| 3,952,709 | 4/1976 | Riddel | 123/231 |

FOREIGN PATENT DOCUMENTS

| | | | |
|---|---|---|---|
| 3011399 | 10/1981 | Germany | 123/231 |

*Primary Examiner*—Michael Koczo
*Attorney, Agent, or Firm*—William M. Hobby, III

[57] ABSTRACT

A rotary internal combustion engine apparatus has an engine housing having a chamber therein having a base along with intake and exhaust ports and a cover attached thereto. A rotor is rotatably mounted in the engine housing chamber which rotor has a rotor support portion extending from each end thereof and rotatably mounted between the housing base and the cover plate. The rotor has a plurality of vane slots therein and a vane control shaft is mounted at a predetermined fixed position within the center portion of the rotor and has two end portions, one of which is fixedly attached to the engine housing camber base and at least two vane position control portions positioned between the end portions. A plurality of vanes are slidably mounted in the rotor plurality of vane control slots for rotation with the rotor. Each vane has a pair of blades therein and a slotted yoke is positioned therebetween and mounted over the vane control shaft vane position control portion for controlling the sliding of each pair of vane blades in each pair of rotor slots in a predetermined path during the rotation of the rotor. The air fuel charge is drawn in through an intake port and compressed as the rotor rotates in the engine housing. An ignition spark plug is positioned in the housing to ignite an air fuel charge compressed by the rotating vanes so that a rotary engine slides a plurality of vane blades in and out of a rotating rotor for compressing an intake air fuel charge and igniting the compressed air fuel to power the rotary internal combustion engine.

7 Claims, 3 Drawing Sheets

ROTARY INTERNAL COMBUSTION ENGINE

BACKGROUND OF THE INVENTION

The present invention relates to a rotary internal combustion engine and especially to a simplified rotary internal combustion engine having sliding vanes controlled by a fixed shaft mounted in the engine rotor.

In the past, many types of engines have been suggested and utilized with the most common types being the standard reciprocating piston engines, radial piston engines, and various types of turbines. Rotary engines have also been commonly suggested to avoid the use of reciprocating parts to increase the efficiency of the engine by saving the energy wasted in converting reciprocal motion to rotary motion. Many of these rotary engines have been tested but have had little success in competing with the smaller reciprocating engines. Some of the prior art rotary engines have included a flap-type piston rotating inside a cylinder with either steam pressure or internal combustion causing the rotation of the pistons. It has also been suggested to mount a rotating piston eccentrically in relation to the main shaft and many complicated arrangements of levers and gears have been tried as have multiple rotating pistons In contrast to the more limited success of rotary combustion type engines, rotor compressors have proved quite successful in pumps, blowers, and the like and one of the most common types of compressors utilized for air conditioners uses a rotor or drum set in a housing with its axis eccentrically mounted on a rotating shaft and a radial blade sliding in a slot to produce a gas tight fit between the intake and exhaust of a compressor.

In recent years, a great deal of attention has been given to rotary combustion engines such as the Wankle engine in which a triangular piston with convex sides rotates on a shaft in a housing having an oval shape with the middle of the oval slightly constricted. The triangular piston in this type of engine has seals mounted on each of its corners which seals continuous ride on the walls of the oval housing.

In contrast to the prior art engines, the present engine is directed to a rotary internal combustion engine having simplified sliding vanes controlled by a fixed shaft mounted in the rotary engine rotor.

Prior rotary engines can be seen in U.S. Pat. No. 4,004,556 to Pfeiffer for a rotary internal combustion engine of the axially sliding vane type and in the Bernard, U.S. Pat. No. 3,150,646 for a rotary engine apparatus having sliding vanes sliding in and out of the rotating rotor. In the Takitani, U.S. Pat. No. 3,809,020, a sliding vane rotary engine and process for obtaining high torque power is provided with a large number of sliding vanes mounted in a rotor rotating in the engine housing. In the Bancroft U.S. Pat. No. 2,037,450, a rotary internal combustion engine has a rotor mounted in a housing with a plurality of cam controlled sliding vanes. Similarly, the Crutchfield, U.S. Pat. No. 4,241,173, has a rotary internal combustion engine with an eccentric control vane sliding in and out of the rotor housing. In the Femons, U.S. Pat. No. 1,217,733, a turbine explosive engine is provided with an engine housing having a rotor mounted therein which forms a chamber at each end by the elongation of the inside of the housing and includes a pair of large vanes, cam controlled along with compression chambers formed in the vanes for operation of the rotary engine. In the Peterson, U.S. Pat. No. 3,118,432, a rotary internal combustion engine has an engine housing with a rotating rotor therein and a plurality of pistons mounted in cylinders in the rotor which are cam controlled to plunge the piston in and out for assisting in controlling the operation of the engine.

A prior rotary compressor can be seen in U.S. Pat. No. 114,558 which uses a control shaft to control the movement of a sliding vane for compressing air.

The present invention relates to a rotary internal combustion engine in which the fuel air charge is drawn in by an intake stroke with a rotating vane blade mounted in a rotor and is compressed by another vane blade pushing the gas in a chamber until all the fuel air charge is ignited by a spark plug to initiate the power stroke. An exhaust stroke follows the power stroke.

SUMMARY OF THE INVENTION

A rotary internal combustion engine apparatus has an engine housing having a chamber therein having a base along with intake and exhaust ports and a cover attached thereto. A rotor is rotatably mounted in the engine housing chamber which rotor has a rotor support portion extending from each end thereof and rotatably mounted between the housing base and the cover plate. The rotor has a plurality of vane slots therein and a vane control shaft is mounted at a predetermined fixed position within the center portion of the rotor and has two end portions, one of which is fixedly attached to the engine housing camber base and at least two vane position control portions positioned between the end portions. A plurality of vanes are slidably mounted in the rotor plurality of vane control slots for rotation with the rotor. Each vane has a pair of blades therein and a slotted yoke is positioned therebetween and mounted over the vane control shaft vane position control portion for controlling the sliding of each pair of vane blades in each pair of rotor slots in a predetermined path during the rotation of the rotor. The air fuel charge is drawn in through an intake port and compressed as the rotor rotates in the engine housing. An ignition spark plug is positioned in the housing to ignite an air fuel charge compressed by the rotating vanes so that a rotary engine slides a plurality of vane blades in and out of a rotating rotor for compressing an intake air fuel charge and igniting the compressed air fuel to power the rotary internal combustion engine.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 2:
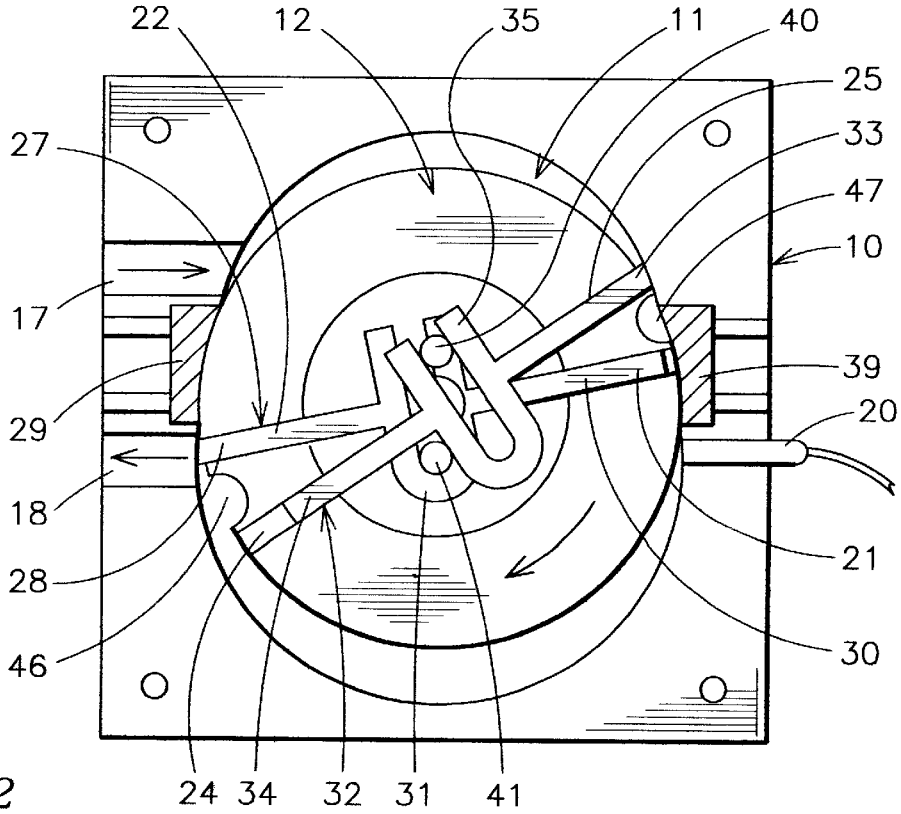
FIG. 2 is a sectional view in accordance with FIG. 1 having the rotary engine rotor in a different position.
Figure 3:
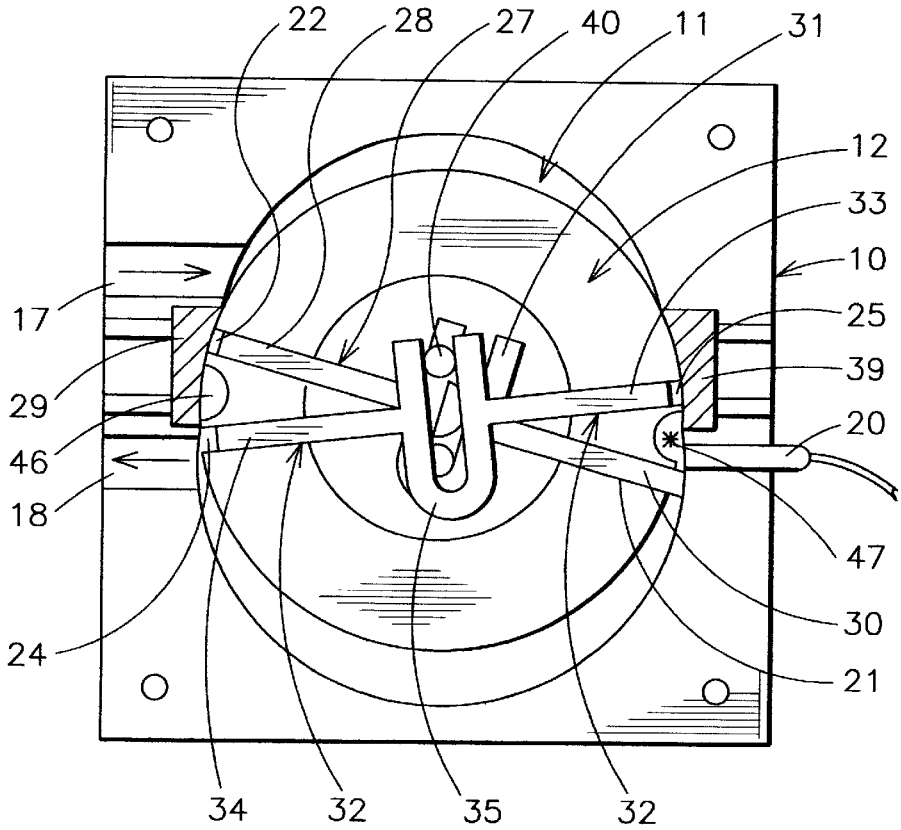
FIG. 3 is a sectional view of the rotary combustion engine in accordance with FIGS. 1 and 2 having the rotary in a position for igniting a fuel charge.
Figure 4:
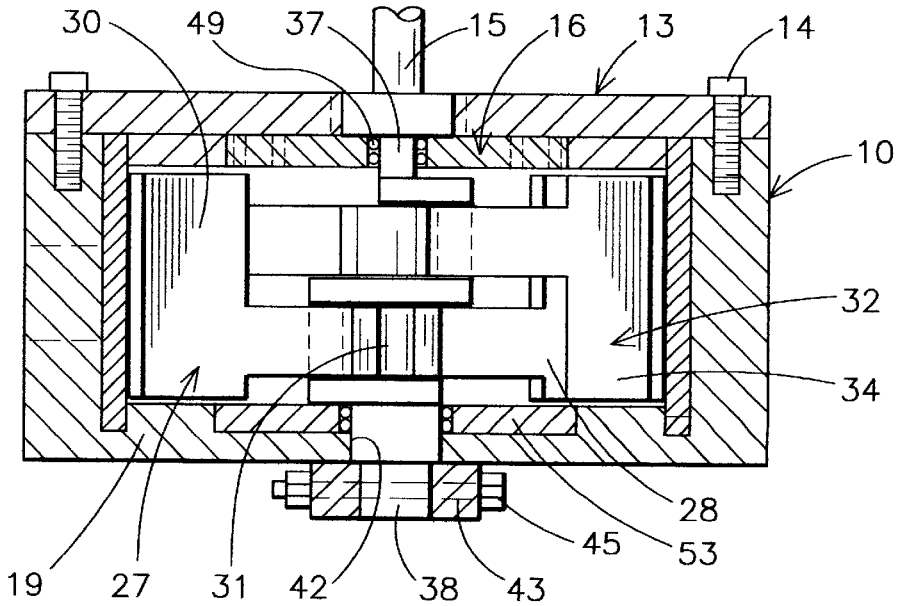
FIG. 4 is a sectional view of the rotary combustion engine of FIG. 1–3.
Figure 5:
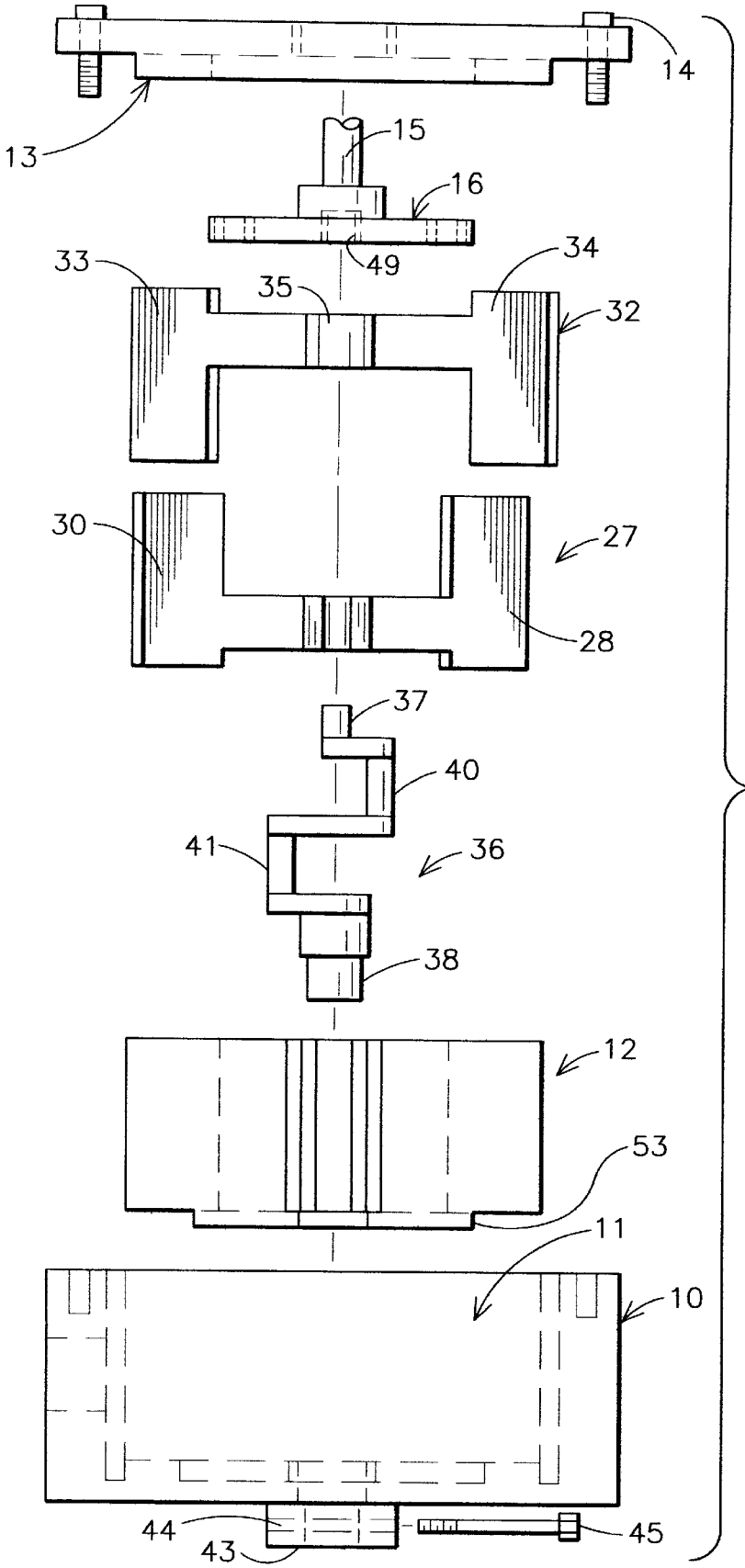
FIG. 5 is an exploded view of the rotary combustion engine of FIGS. 1–4.

Referring to the drawings, FIGS. 1–5, an internal combustion engine has an engine housing 10 having a chamber 11 thereinside and having an engine rotor 12 rotatably mounted therein. The engine housing includes a top mounting plate or cover 13, as seen in FIGS. 4 and 5, attached to the engine housing with threaded fasteners 14 and a base 19. A protruding rotor shaft 15, as seen in FIG. 4, extends from a rotor top member 16 which is attached to the rotor 12 and produces the power output of the engine as the rotor 12 rotates within the engine housing. The engine housing 10 and air fuel charge inlet port 17 and an exhaust port 18 are positioned for drawing the air fuel charge into the rotary combustion engine and driving the exhaust from the engine. A spring loaded engine seal (not shown) is mounted in the engine housing 10 between the ports 17 and 18 and a second spring loaded engine seal 39 is mounted on the opposite side of the engine housing 10 from the engine housing seal 29. These seals form a seal between the rotor and engine housing. An ignition spark plug 20 is shown mounted for igniting a compressed air fuel charge in the engine. The engine rotor 12 has a rotor base 53 and has vane slots 21 and 22 opposite each other and passing through the rotor 12 into a hollow center portion of the rotor 12. A second pair of vane slots 24 and 25 also pass through the rotor 12 in predetermined positions. A first sliding vane 27 has a pair of blades 28 and 30 attached to a center yoke 31. A second vane 32 has a pair of sliding blades 33 and 34 on each end thereof and having a motion controlling yoke 35 therebetween. A vane control shaft 36 is mounted in the hollow center portion of the rotor 12 and has supporting end portions 37 and 38 connected to two spaced vane control portions 40 and 41. The end portion 38 of the vane control shaft 36 extends through an opening 42 in the engine housing 10 base 19 and into a locking extension 43 which has an aperture 44 passing therethrough for insertion of the locking pin 45 to fixedly attach the vane control shaft 36 to the engine housing 10 on the one end thereof. The other end 37 of the vane control shaft 36 fits into a bearing sleeve 49 to support it within the power shaft plate 16 in a rotary fashion so that the rotation of the rotor with the plate 16 attached will allow the vane control shaft 36 to remain fixed to the engine housing 10. The vane 32 has the blades 33 and 34 on each end thereof, as seen in FIG. 5, connected to the center yoke 35 which in turn is fitted over the vane control portion 40 of the vane control shaft 36. The vane 27 has its yoke 31 fitting over the vane control portion 41 to control the movement of the vane and the vane blades as the rotor 12 is rotated within the engine housing 10. The rotor 12 also has removed portions 46 located between the vane blades 28 and 34 and a removed portion 47 positioned between the vane blades 30 and 33 to allow the rotor to carry a greater volume of the fuel charge.

Figure 1:
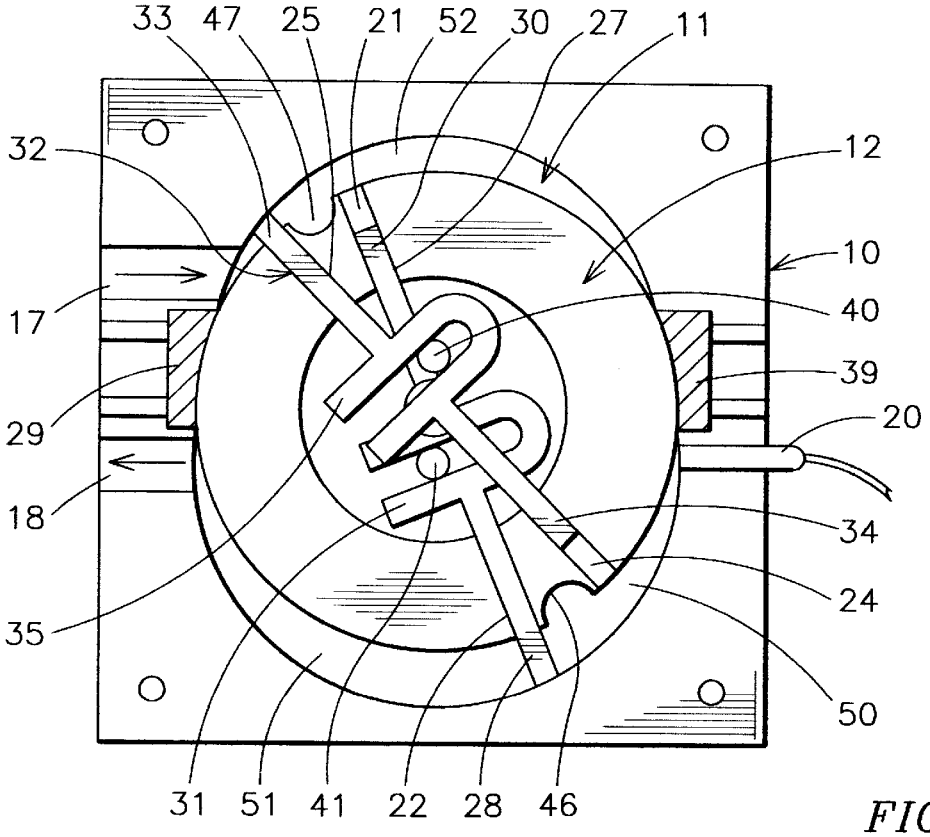
FIG. 1 is a sectional view taken through a rotary internal combustion engine in accordance with the present invention.

As seen in FIGS. 1–3, the rotor 12 rotates in a clock-wise direction. FIG. 1 has the fuel charge in the chamber portion 50 ignited by the spark plug 20 and in the power stroke while the chamber portion 51 is driving the exhaust gases towards the exhaust port 18 and a new fuel air charge is being drawn into the intake port 17 while a fuel charge is being compressed in a compression chamber portion 52. In FIG. 2, the engine rotor has been moved to a different position and in FIG. 3, the rotor and vanes have been moved to yet a different position illustrating the motion of the vane blades. The vanes slide in and out in pairs on opposite sides of the rotor, always controlled by the fixed vane control shaft 36 having the yokes 31 and 35 therearound. The yoke control shaft portions 40 and 41 allow the yokes to slide on the shaft portions while the rotor 12 is moving the vane blades and vanes in a rotary fashion, moving the vane blades in and out of their respective slots from a retracted position within the rotor vane slots to an extended position adjacent the internal walls of the chamber 11 of the engine housing 10. The use of a single fixed vane control shaft fixedly mounted to the engine housing located in the middle of the rotor for controlling a pair of yoked vanes, each having a pair of vane blades, one on each end thereof, sliding in vane slots within the rotating rotor simplifies the mechanism for controlling the vanes in an internal combustion rotary engine so that a two or four stroke engine can be operated through a simple mechanism which can be easily manufactured and disassembled for repair.

It should be clear however that the present invention is not to be limited to the forms shown which are considered to be illustrative rather than restrictive.

I claim:

1. A rotary internal combustion engine comprising:

an engine housing having a chamber therein having a base and intake and exhaust ports, and said housing having a cover attached thereto;

a rotor having a plurality of vane control slots, said rotor being rotatably mounted in said engine housing chamber and having a pair of rotor support portions extending therefrom and rotatably mounted to said housing between said base and said cover, and said rotor having a hollow center portion a vane control shaft mounted in said rotor hollow center portion, said vane control shaft having two end portions, one said end portion being fixedly attached to said engine housing and said vane control shaft having at least two vane position control portions between said two end portions;

a plurality of vanes slidably mounted in said rotor plurality of vane control slots for rotation with said rotor, each said vane having a pair of blades thereon and having a slotted yoke positioned therebetween and mounted over one said vane control shaft vane position control portion for controlling the sliding of each said pair of vane blades in each pair of said rotor slots in a predetermined path during the rotation of said rotor to draw in an air-fuel charge through said intake port and compress said air-fuel charge as said rotor rotates in said engine housing and to discharge exhaust through said exhaust port; and ignition means positioned in said housing to ignite an air-fuel charge compressed by said rotating vanes; whereby a rotary engine slides a plurality of vanes in and out of a rotating rotor for compressing an intake air-fuel charge and ignites a compressed air-fuel to power a rotary internal combustion engine.

2. A rotary internal combustion engine in accordance with claim 1 in which said vane control shaft has an offset center portion forming a generally U-shaped shaft portion.

3. A rotary internal combustion engine in accordance with claim 2 in which said rotor has four vane slots and one of said plurality of vanes slidably mounted through each two of said vane slots.

4. A rotary combustion engine in accordance with claim 3 in which said rotor is rotatably supported on said vane control shaft on one side of said rotor.

5. A rotary combustion engine in accordance with claim 4 in which said vane control shaft is supported in said rotor in a bearing to allow said rotor to rotate thereon.

6. A rotary combustion engine in accordance with claim 5 in which one said rotor support portion extends from said housing as a power output shaft.

7. A rotary internal combustion engine in accordance with claim 6 in which a gas collecting pocket is formed in said rotor between each of said pair of vane blades.

* * * * *